US011325219B2

(12) United States Patent
Bettermann

(10) Patent No.: US 11,325,219 B2
(45) Date of Patent: May 10, 2022

(54) MACHINING DEVICE AND MACHINING METHOD

(71) Applicant: HOMAG Bohrsysteme GmbH, Herzebrock-Clarholz (DE)

(72) Inventor: Thomas Bettermann, Bielefeld (DE)

( * ) Notice: Subject to any disclaimer, the term of this patent is extended or adjusted under 35 U.S.C. 154(b) by 626 days.

(21) Appl. No.: 16/322,469

(22) PCT Filed: Aug. 2, 2017

(86) PCT No.: PCT/EP2017/069520

§ 371 (c)(1),
(2) Date: Jan. 31, 2019

(87) PCT Pub. No.: WO2018/024769

PCT Pub. Date: Feb. 8, 2018

(65) Prior Publication Data

US 2019/0232455 A1 Aug. 1, 2019

(30) Foreign Application Priority Data

Aug. 5, 2016 (DE) ..... 10 2016 214 568.1

(51) Int. Cl.

| | |
|---|---|
| ***B24B 21/08*** | (2006.01) |
| ***B24B 21/10*** | (2006.01) |
| ***B24B 49/16*** | (2006.01) |
| ***B24B 49/10*** | (2006.01) |

(52) U.S. Cl.

CPC ..... *B24B 21/08* (2013.01); *B24B 21/10* (2013.01); *B24B 49/10* (2013.01); *B24B 49/16* (2013.01)

(58) Field of Classification Search

CPC ..... B24B 21/08; B24B 21/10; B24B 49/10; B24B 49/105; B24B 49/16

USPC ..... 451/5, 9, 10, 11, 12, 59, 300, 303

See application file for complete search history.

(56) References Cited

U.S. PATENT DOCUMENTS 4,601,134 A * 7/1986 Hessemann ..... B24B 21/06 451/300
4,839,994 A * 6/1989 Heesemann ..... B24B 49/10 356/606
5,486,129 A * 1/1996 Sandhu ..... B23Q 15/013 451/10

(Continued)

FOREIGN PATENT DOCUMENTS

CN 1905995 A 1/2007
CN 101479075 A 7/2009

(Continued)

*Primary Examiner* — Eileen P Morgan

(74) *Attorney, Agent, or Firm* — Morgan, Lewis & Bockius LLP

(57) ABSTRACT

The present invention relates to a device for sanding surfaces of a workpiece, preferably at least portions of which are made of wood, a manufactured wood product, plastic or such like. The present invention further relates to a sanding method and to a sanding machine comprising: a carrier element (11), a plurality of pressure segments (12*a*, 12*b*, 12*c*) which can be actuated, in particular electromagnetically actuated, and which are disposed along the carrier element (11) and are each designed to press a sanding element, especially a sanding belt (21), against a workpiece (1), and at least one sensor (13*a*, 13*b*, 13*c*) for sensing a compressive force applied to a workpiece by one of the pressure segments.

23 Claims, 3 Drawing Sheets

(56) References Cited

U.S. PATENT DOCUMENTS

| | | | | |
|---|---|---|---|---|
| 5,868,896 | A * | 2/1999 | Robinson | B24B 37/013 156/701 |
| 6,186,865 | B1 * | 2/2001 | Thornton | B24B 21/08 451/307 |
| 6,290,570 | B1 * | 9/2001 | Heesemann | B24B 21/08 451/10 |
| 6,325,706 | B1 * | 12/2001 | Krusell | H01L 21/3212 451/296 |
| 6,520,834 | B1 * | 2/2003 | Marshall | B24B 37/04 451/10 |
| 6,837,774 | B2 * | 1/2005 | Hu | B24B 21/04 451/285 |
| 7,160,177 | B2 * | 1/2007 | Herold | B24B 37/30 451/288 |
| 7,935,216 | B2 * | 5/2011 | Brown | B24B 49/16 156/345.13 |
| 9,696,710 | B2 * | 7/2017 | Cone | G01H 1/00 |
| 10,160,094 | B2 * | 12/2018 | Lipson | B24B 49/16 |
| 10,427,269 | B2 * | 10/2019 | Kashiwagi | B24B 51/00 |
| 2006/0135040 | A1 * | 6/2006 | Herold | B24B 49/16 451/5 |
| 2008/0004743 | A1 * | 1/2008 | Goers | B24B 53/017 700/121 |

FOREIGN PATENT DOCUMENTS

| | | | | |
|---|---|---|---|---|
| CN | 102601711 | A | 7/2012 | |
| DE | 2634829 | A1 | 2/1978 | |
| DE | 3716832 | | 12/1988 | |
| DE | 102004003203 | A1 | 8/2005 | |
| EP | 0155380 | A1 | 9/1985 | |
| JP | 2002059349 | A | 2/2002 | |
| WO | 0232623 | A1 | 4/2002 | |
| WO | WO-2004103639 | A1 * | 12/2004 | B24B 21/08 |

* cited by examiner

MACHINING DEVICE AND MACHINING METHOD

TECHNICAL AREA

The present invention relates to a device for sanding surfaces of a workpiece, which is preferably formed at least in sections of wood, wood material, synthetic, or the like. Furthermore, the present invention relates to a sanding machine and a method.

PRIOR ART

In the prior art, sanding machines comprise carrier elements having carrier element segments, wherein the latter can be adjusted individually to press a sanding belt against a section of a workpiece to be machined. The extension movement of the carrier element segments is initiated by a control unit, to which items of information with respect to the workpiece are supplied.

However, for example, if a workpiece is machined which has height differences over the machining travel, the contact pressure forces on the workpiece vary. This can result in different sanding results within specific, defined thickness tolerances.

DESCRIPTION OF THE INVENTION

The object of the present invention is to provide a device and a method, using which sanding machining can be carried out more exactly.

The subject matter of Claim 1 provides a device for this purpose. Claim 15 relates to a method for machining a workpiece. Further preferred embodiments are set forth in the dependent claims, which can each be combined individually with the independent claims.

Inter alia, the advantages mentioned hereafter can be achieved by the device according to the invention or the method according to the invention. In particular, it is possible to keep the sanding result constant under changing conditions (thickness differences of a workpiece). Furthermore, the forces measured by the sensors can be stored and analyzed later. If the optimum settings for the application of the machine are known, direct feedback to the operator with proposed improvements can thus be performed.

Furthermore, it is possible to ascertain the optimum settings with respect to the sanding pressure individually. Together with other collected customer data of the user of the device, it is possible for the producer of such a device to better comprehend the corresponding operating behavior and further improve it by proposals or design changes.

If it is established, for example, that an excessively high sanding pressure is consistently applied, individual pressure segments can thus be readjusted.

The device according to the invention for sanding a workpiece has in this case a carrier element and a plurality of pressure segments, which are arranged along the carrier element and which are each designed to press a sanding element, in particular a preferably circulating sanding belt, against a workpiece. Furthermore, the device comprises at least one sensor, which is used to detect a pressure force applied by one of the pressure segments to a workpiece. By detecting the pressure force, changing conditions can be detected, for example, in the event of thickness differences of a workpiece, and these results can be used to improve the sanding machining.

The device comprises in this case pressure segments which are preferably each movable electromagnetically. This embodiment results in a rapid and accurate control of the corresponding pressure segments.

The device preferably comprises a control unit, which is configured to compare a pressure force detected by the at least one sensor to a force setpoint value and to vary a type and/or duration of an actuation of the corresponding pressure segment to achieve the force setpoint value. By way of this device, the sanding result can be kept constant under changing conditions, for example, in the event of thickness differences of a workpiece. For example, magnetic actuators are excited using longer or shorter current pulses, in order to vary the corresponding sanding pressure.

The control unit mentioned can be the central control unit of the device or a decentralized control unit arranged in the region of or on the carrier element.

In one preferred embodiment of the present invention, a sensor is provided for each pressure segment to detect a pressure force. This sensor is either arranged continuously on the sanding tongue or in sections on each pressure segment, for example, fastened on the pressure segments, whereby an efficient and integrated registration of the pressure force is ensured.

In one embodiment, it is preferable for one sensor to be attached to each of the pressure segments, wherein it is preferable for the sensors to be embodied as film-like. Since a pressure force can be detected on each pressure segment, the pressure segments can accordingly be monitored individually and the pressure force thereof applied to the workpiece can be regulated if necessary. The film-type embodiment of the sensors enables an extremely compact construction.

Furthermore, the device can have a sanding tongue which extends along the carrier element, wherein it is preferable for the sensor or sensors to be provided between the sanding tongue and the carrier element. A precise section-by-section detection of the pressure can be ensured by this embodiment.

According to another embodiment of the device, the sensors are or the sensor is attached on the sanding tongue or integrated into the sanding tongue. The sanding tongue is a replaceable component, so that no complex structural changes are necessary with a sensor attached in this manner.

In one embodiment, it is preferable for the sensors to be provided between the sanding tongue and the respective pressure segment. A compact arrangement can thus be achieved according to this embodiment.

According to one particular embodiment of the device, the pressure segments each have a preferably plate-shaped contact section for contact against a sanding belt and a preferably cylindrical guide section for guiding a movement of the pressure segment, whereby the movement is enabled. It is preferable for the preferably film-type sensor to be attached to the side of the contact section facing toward the sanding element, in particular sanding belt.

The device can furthermore have a light bar, which is in particular an LED light bar, which can light up in different colors in sections, and is designed so that the ratio of the force setpoint value and the detected pressure force can be represented qualitatively via the light in a specific color of the respective section. The user thus receives optical feedback about this ratio.

The LED bar of the device can furthermore preferably light up in a specific color, which signals that the detected pressure force of the corresponding pressure segment is greater than the predefined force setpoint value. The association of a specific color with this excessively high pressure can thus be communicated to the user so that the user can react to this event.

In this embodiment, the detected pressure forces and the corresponding force setpoint value can optionally additionally be stored. An analysis of the stored data can thus be performed at a later point in time.

Furthermore, the detected and stored pressure forces and corresponding force setpoint values can optionally be transmitted to an external server. The data thus collected can thus be centrally collected, analyzed, and used further. For example, data can be transmitted to an upstream or downstream machine, in order to set its characteristic values in accordance with the device according to the invention.

Furthermore, the device can preferably be configured to transmit the detected pressure force by means of wireless data transmission, in particular RFID technology, to the control unit. This reduces the weight of the device. Furthermore, the installation is simplified.

Furthermore, the invention relates to a sanding machine having a device according to one of the preceding aspects and a movement unit for inducing a relative movement between a workpiece and the carrier element. Furthermore, the movement unit can preferably comprise a conveyor band or one or more conveyor belts. The sanding machine is preferably a wide-belt sanding machine or a cross-belt sanding machine.

In addition to the above-described device, the sanding machine can comprise a workpiece detection unit, using which a workpiece to be machined is detected. One pressure segment or multiple pressure segments is/are actuated based on the workpiece detection in order to carry out sanding machining.

In an alternative embodiment, the carrier element can also be moved, wherein the workpiece is kept stationary or also moved during the movement of the carrier element.

The method according to the invention for machining a workpiece, which preferably uses a device as described above, comprises:

producing a relative movement between a workpiece and a carrier element, wherein a plurality of pressure segments is arranged along the carrier element, machining the workpiece by way of a sanding element, in particular by way of a sanding belt, wherein at least one of the pressure segments is pressed against the sanding element, wherein a pressure force applied to the workpiece by at least one pressure segment is detected by a sensor.

Furthermore, it is preferable for the detected pressure force to be compared to a force setpoint value, and the pressure segment to be moved to achieve the force setpoint value. By way of this method, a sanding result can be kept constant under changing conditions, for example, in the event of thickness differences of a workpiece.

The above-discussed modifications of the device according to the invention can also be used in the scope of the method.

According to a further object, the following device is provided:

a device for sanding a workpiece having:

a carrier element, a plurality of pneumatically actuated pressure segments, which are arranged along the carrier element and are each designed to press a sanding element, in particular a sanding belt, against a workpiece, at least one sensor for detecting a pressure force applied by one of the pressure segments to a workpiece.

The device according to this object can have features according to one or more of the above-mentioned preferred embodiments or the features reflected in one or more of the dependent claims. Such a device can also be used in the scope of a method as described in independent Claim 16.

DETAILED DESCRIPTION OF PREFERRED EMBODIMENTS

A preferred embodiment of the present invention will be described hereafter on the basis of the appended figures. Further modifications of specific individual features mentioned in this context can each be combined with one another individually to form new embodiments.

Figure 1:
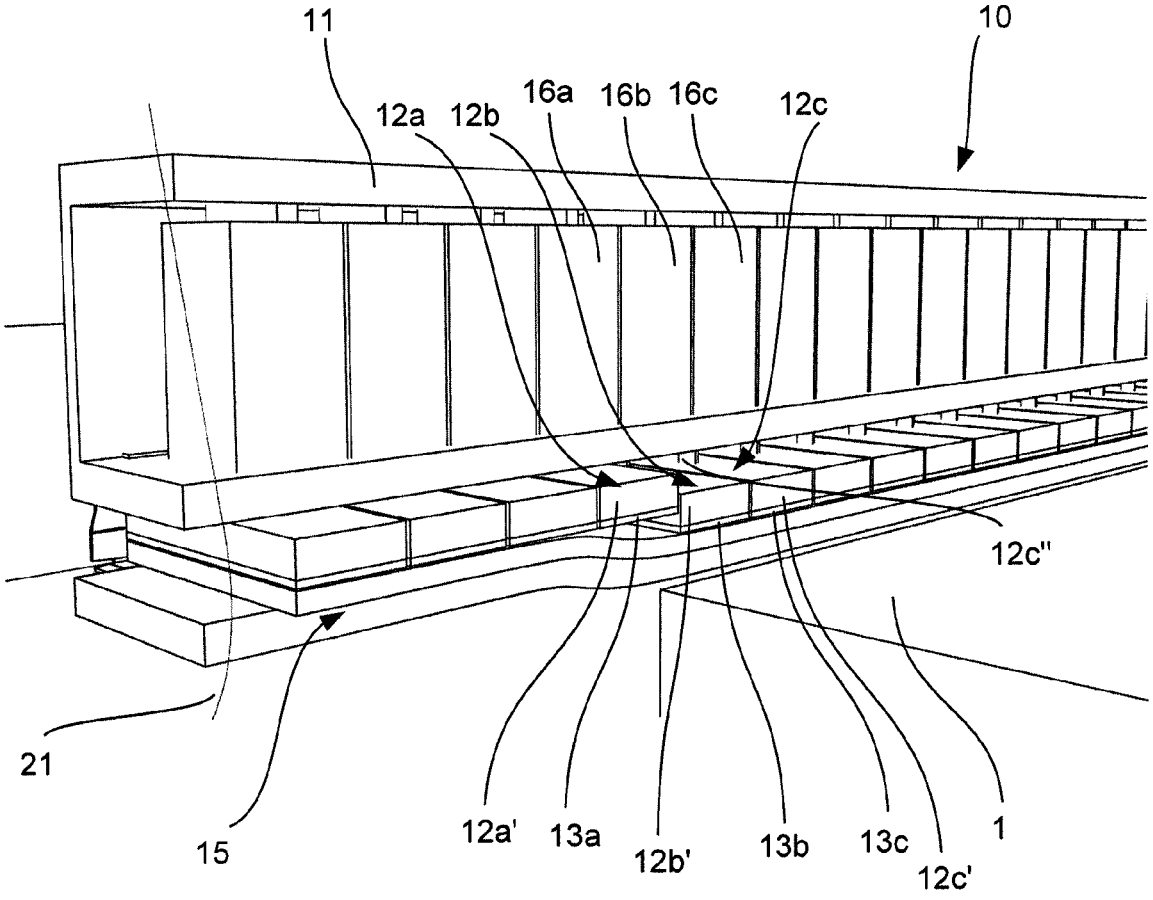
FIG. 1 shows a detail view of one embodiment of the device according to the invention.
Figure 3:
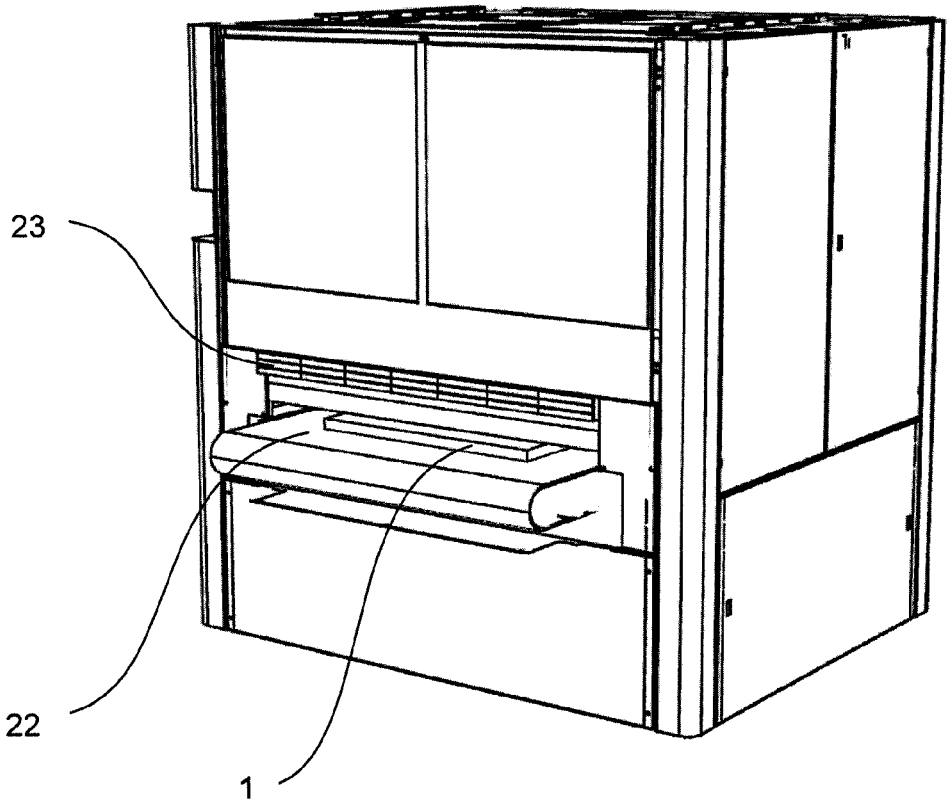
FIG. 3 shows a perspective view of the embodiment of the present invention.

FIG. 1 shows a detail view of a device 10, which is a sanding assembly of a wide-belt sanding machine in the embodiment explained here. A perspective illustration of the wide-belt sanding machine, in which multiple sanding assemblies can be accommodated, is shown in FIG. 3. It is apparent that the device 10 can also be used in a cross-belt sanding machine.

Figure 2A:
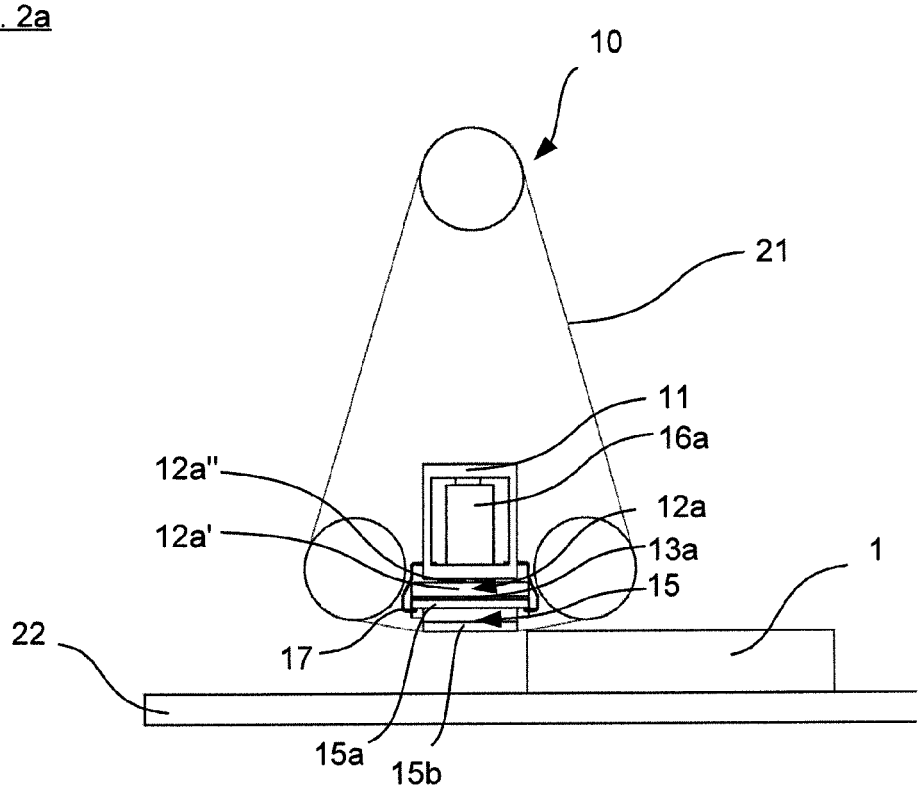
FIG. 2*a* is a schematic cross-sectional view of the embodiment of the device according to the invention having lowered pressure segments.
Figure 2B:
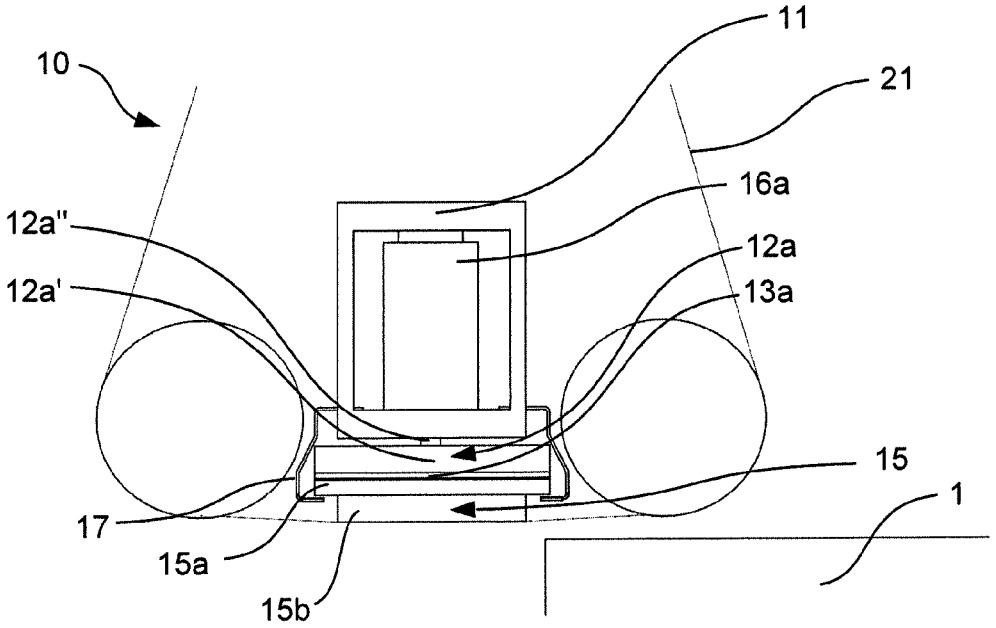
FIG. 2*b* is a schematic cross-sectional view of the embodiment of the device according to the invention having raised pressure segments.

The device 10 comprises a carrier element 11, which extends over a machine bed not shown in detail in FIGS. 1-2. The carrier element 11 is located inside the housing of the wide-belt sanding machine shown in FIG. 3 and extends transversely to the conveyance path of a workpiece. In particular, a workpiece 1 can be moved by means of a preferably circulating conveyor band 22 and guided through in this way below the carrier element 11.

Multiple guides 16*a*, 16*b*, 16*c* are fastened on the carrier element 11, which, in the vertical direction, extend toward the machine bed and thus in the direction of the conveyor band 22. Magnetic actuators are accommodated in the guides 16*a*, 16*b*, 16*c*.

Each of the guides 16*a*, 16*b*, 16*c* is connected to one pressure segment 12*a*, 12*b*, 12*c*, wherein the pressure segments can be moved in relation to the guides 16*a*, 16*b*, 16*c*. By way of a movement of a pressure segment 12*a*, 12*b*, 12*c* in the direction of a sanding belt 21, it is pressed in sections against the workpiece 1, as explained hereafter.

The pressure segments 12*a*, 12*b*, 12*c* each comprise a plate-shaped contact section 12*a*', 12*b*', 12*c*', to be able to press a sanding belt 21 against a workpiece 1, and a cylindrical guide section 12*a*", 12*b*", 12*c*", to guide a movement of the pressure segment 12*a*, 12*b*, 12*c* inside the respective guide 16*a*, 16*b*, 16*c*. If the magnetic actuator accommodated in the respective guide is actuated, the corresponding pressure segment is moved downward (in the direction of the conveyor band 22) in the vertical direction.

To actuate a magnetic actuator, which causes an extension movement of a pressure segment 12*a*, 12*b*, 12*c*, a specific current value is supplied thereto. The sanding pressure can be set depending on the type and/or duration of the actuation. The magnetic actuator is excited using current pulses, to apply a higher or lower pressure force to the workpiece depending on the type and/or length of the current pulses. The sanding pressure is varied in this manner.

A sanding tongue 15, which extends along the carrier element 11, is provided in the vertical direction below the plurality of the pressure segments 12*a*, 12*b*, 12*c*. The sanding tongue 15 is thus provided between the sanding belt 21 (circulating via multiple rollers in the present exemplary embodiment) and the pressure segments 12*a*, 12*b*, 12*c*.

The sanding tongue 15 comprises multiple sections, comprising a base element 15*a* and a cushion 15*b* arranged below it. A holder 17, which is fastened on the carrier element 11, is in contact with the base element 15*a* and thus holds the sanding tongue 15 on the carrier element 11. On the side of the cushion 15*b* facing toward the rear side of the sanding belt 21, a sliding layer is provided, to let the sanding belt slide with the least possible friction over the cushion 15*b*.

In each case a sensor 13*a*, 13*b*, 13*c*, fastened according to the present embodiment on the pressure segments 12*a*, 12*b*, 12*c*, is inserted between each of the pressure segments 12*a*, 12*b*, 12*c* and the sanding tongue 15. The sensors 13*a*, 13*b*, 13*c* are formed flat and can thus advantageously be arranged between a respective pressure segment or sanding tongue 15. A force applied by the respective pressure segment to a section of the workpiece 1, and thus the local sanding pressure, can be detected using the sensors.

The sensors 13*a*, 13*b*, 13*c* are connected to a control unit of the device 10 or the wide-belt sanding machine. Pressure force setpoint values, using which the pressure segments are each to be pressed in case of usage against the workpiece 1, are stored in the control unit. The control unit is furthermore configured to compare pressure force actual values, which are detected by the sensors of the actuated pressure segments, to a respective pressure force setpoint value, and to carry out a regulation of the pressure force on the workpiece based on this comparison. In this manner, deviations of the workpiece thickness can be taken into consideration and a uniform local sanding pressure can be enabled.

One embodiment of a wide-belt sanding machine having the device 10 according to the invention is shown from the outside in FIG. 3. A light bar 23, in particular an LED light bar, which extends transversely to the movement direction of the conveyor band 22, is provided above a loading region for placing a workpiece on the conveyor band 22. The light bar 23 is connected to the control unit.

The control unit can be configured to transmit the detected pressure force in each segment to an external server. These data can be relayed to an upstream machine for analysis or information, for example, in order to control the processes thereof in this manner, for example.

The light bar 23 can light up in various colors in sections and can thus display the ratio of the force setpoint value and the force actual value qualitatively via the lighting in a specific color of the respective section. If it is indicated by means of a red color, for example, via a region of the light bar 23, that an excessively high pressure is used for sanding, this can thus be noted and/or taken into consideration by the operating personnel and/or automatically readjusted.

Multiple regions arranged in columns and rows are defined on the LED bar. In this case, the rows depict, for example, multiple sanding assemblies arranged in succession in the machine. Degrees of wear of the assemblies in a specific segment can be indicated to the operator, for example, in the corresponding fields of the columns.

A method for machining a workpiece using the wide-belt sanding machine, which comprises the device 10 of the present embodiment, will be described hereafter.

Firstly, a workpiece 1 is deposited or laid on the conveyor band 22. The circulating conveyor band 22 moves the workpiece 1 in the direction of the carrier element 11, which comprises the plurality of the pressure segments 12*a*, 12*b*, 12*c*. Based on the results of a workpiece detection unit (not shown), which is upstream from the carrier element in the passage direction of the workpiece and detects the presence of a workpiece, specific pressure segments are moved in the direction of the conveyor band 22 in relation to the carrier element 11, in order to bring the sanding belt 21 into contact with the workpiece 1 in sections.

A cross-sectional view of the embodiment of the device according to the invention having at least some lowered pressure segments is shown in FIG. 2*a*, so that the sanding belt 21 is pressed against the workpiece by the lowered pressure segments.

Such a movement of the pressure segments 12*a*, 12*b*, 12*c* is carried out depending on the design of the workpiece 1. If the workpiece 1 is a frame part (for example, a window frame), the pressure segments 12*a*, 12*b*, 12*c*, using which the sanding belt 21 is to be brought into contact with the corresponding section of the workpiece 1, are thus extended at the longitudinal sides of the workpiece 1. In the situation shown in FIG. 1, pressure segments (in this example four) are located in the peripheral region in the starting position thereof, while further pressure segments 12*a*, 12*b*, 12*c* are actuated.

The sensors 13*a*, 13*b*, 13*c* provided between the sanding tongue 15 and each pressure segment 12*a*, 12*b*, 12*c* continually detects forces which are applied by the pressure segments 12*a*, 12*b*, 12*c* to the respective section of the workpiece 1.

The detected forces are transmitted to the control unit and can be compared to corresponding setpoint values. Based on this comparison, the extended position of the respective pressure segment can be readjusted. It is thus possible to compensate for varying workpiece thicknesses, which are in the tolerance range of a workpiece detection unit (not shown) and can result along the machining line. In other words, a uniform sanding pressure can be ensured over the entire workpiece. This sanding pressure can be, for example, a workpiece-specific or application-specific sanding pressure, which no longer has to be changed thereafter after setting.

The invention claimed is:

1. A device for sanding a workpiece, comprising:

a carrier element;

a plurality of pressure segments, which can be actuated, are arranged along the carrier element and are each configured to press a sanding element against the workpiece; and at least one sensor for detecting a pressure force applied by one of the plurality of pressure segments to the workpiece, wherein the device comprises a sanding tongue, which extends along the carrier element, wherein the at least one sensor is provided between the sanding tongue and the respective pressure segment, and wherein each of the plurality of pressure segments is electromagnetically movable by a magnetic actuator accommodated in a guide provided on the carrier element.

2. The device according to claim 1, wherein each of the plurality of pressure segments has a plate-shaped contact section for contact against a sanding belt and a cylindrical guide section for guiding a movement of the respective pressure segment.

3. The device according to claim 2, wherein the at least one sensor is a film-shaped sensor and is attached on a side of the plate-shaped contact section facing toward the sanding element.

4. The device according to claim 1, further comprising:

a light bar which can light up in various colors in sections, and is configured to qualitatively display a ratio of a force setpoint value and a detected pressure force via the lighting in a specific color of the respective section.

5. The device according to claim 4, wherein lighting of a section of the light bar in a specific color signals that the detected pressure force of the corresponding pressure segment is greater than a predefined force setpoint value.

6. The device according to claim 4, wherein the light bar is an LED bar.

7. A sanding machine having the device according to claim 1 and a movement unit for inducing a relative movement between the workpiece and the carrier element.

8. The sanding machine according to claim 7, wherein the movement unit comprises a conveyor band, one or more conveyor belts or conveyor rollers.

9. A method for machining the workpiece using the device according to claim 1, comprising:

producing a relative movement between the workpiece and the carrier element, wherein the plurality of pressure segments are arranged along the carrier element; and machining of the workpiece by the sanding element, wherein at least one of the plurality of pressure segments presses the sanding element against the workpiece by way of an electromagnetic actuation, wherein the pressure force applied by the one of the plurality of pressure segments to the workpiece is detected by the at least one sensor.

10. The method according to claim 9, wherein the sanding element is a sanding belt.

11. The method according to claim 9, wherein the detected pressure force is compared to a force setpoint value and the one of the plurality of pressure segments is actuated to achieve the force setpoint value.

12. The device according to claim 1, wherein the plurality of pressure segments can be electromagnetically actuated.

13. The device according to claim 1, wherein the sand element is a sanding belt.

14. The device according claim 1, wherein the at least one sensor is provided between the sanding tongue and the carrier element.

15. The device according to claim 1, wherein the at least one sensor is embodied as film-shaped.

16. The device according to claim 1, further comprising:

a control unit which is configured to compare the pressure force detected by the at least one sensor to a force setpoint value and to vary a type or a duration of an actuation of the corresponding pressure segment to achieve the force setpointvalue.

17. The device according to claim 16, wherein the control unit is configured to store the detected pressure force and the force setpoint value.

18. The device according to claim 16, wherein the control unit is configured to transmit the detected pressure force to an external server.

19. The device according to claim 16, wherein the device is configured to transmit the detected pressure force by means of wireless data transmission to the control unit.

20. The device according to claim 19, wherein the wireless data transmission corresponds to RFID technology.

21. The device according to claim 1, wherein a sensor for detecting a pressure force is provided for each pressure segment, or a continuous sensor is provided, which has multiple sensor sections, which are each configured to detect a pressure force applied by a pressure segment to the workpiece.

22. The device according to claim 1, wherein one sensor is attached to each of the plurality of pressure segments.

23. The device according to claim 22, wherein the at least one sensor is embodied as film-shaped.

* * * * *